United States Patent [19]

Martin

[11] Patent Number: 4,624,027

[45] Date of Patent: Nov. 25, 1986

[54] MOVABLE HANDLE STRUCTURE FOR CONTROL OF SELF-PROPELLED VACUUM CLEANER

[75] Inventor: Dean C. Martin, Golden Valley, Minn.

[73] Assignee: Whirlpool Corporation, Benton Harbor, Mich.

[21] Appl. No.: 663,737

[22] Filed: Oct. 22, 1984

[51] Int. Cl.[4] ..... A47L 9/00

[52] U.S. Cl. ..... 15/340; 15/410; 180/19.3

[58] Field of Search ..... 15/340, 410; 180/19.3

[56] References Cited

U.S. PATENT DOCUMENTS

| | | | |
|---|---|---|---|
| 2,328,238 | 8/1943 | Troxler | 306/13 |
| 2,937,706 | 5/1960 | Chandler | 180/19.3 |
| 3,031,710 | 5/1962 | Huening, Jr. | 15/359 |
| 3,218,876 | 11/1965 | Berger | 74/202 |
| 3,220,043 | 11/1965 | Lampe | 15/340 |
| 3,618,687 | 11/1971 | Ripple et al. | 180/19 H |
| 3,857,076 | 12/1974 | Hetland | 318/257 |
| 3,938,216 | 2/1976 | Schmitz et al. | 15/340 |
| 4,155,143 | 5/1979 | Garbe | 15/410 |
| 4,249,281 | 2/1981 | Meyer et al. | 15/340 |
| 4,342,369 | 8/1982 | Ransom | 180/19 H |

*Primary Examiner*—Chris K. Moore

*Attorney, Agent, or Firm*—Wood, Dalton, Phillips, Mason, & Rowe

[57] ABSTRACT

An improved movable control for a self-propelled upright vacuum cleaner. The control includes a sleeve longitudinally movably mounted on the distal end of the upright handle of the vacuum cleaner and includes locking structure for retaining the sleeve in a center neutral position, wherein the drive of the nozzle wheels is maintained in a neutral condition. The locking structure is readily manipulatible to release the sleeve from the neutral position when desired and permit it to be moved in opposite directions so as to effect corresponding forward or rearward operation of the drive. The sleeve is maintained relatively short while yet providing a long travel in providing facilitated user control of the drive operation. The sleeve is provided in two halves which are secured together by an improved securing arrangement. In one form, the locking structure is pivotable about an axis parallel to the handle end portion, and in another form, the locking means is pivotable about an axis transversely thereto.

21 Claims, 13 Drawing Figures

19
2
16
2
10
11
13
12
33
30
32
31
15
18
19
34
17
25
22
23
5
20
5
23
52
27
38
39
39
21
40
42
41
16
15
14
24
51
22
50
21
16

30
19
18
17
43
24
6
6
20
51
26
52
25
16
15
14

26
24
25
21

22
23
28
24
29
27
21
26
23
22

27
26
24
23
28
21
27
26

35
36
19b
19
19a
34
53
17
39
51
52
37
38
39
15
14

134
146
147
120
144
145
17

148
148
19
147
13
13
146
N
149
120
17

19
120
149
146
147
17
148

MOVABLE HANDLE STRUCTURE FOR CONTROL OF SELF-PROPELLED VACUUM CLEANER

BACKGROUND OF THE INVENTION

1. Field of the Invention

This invention relates to vacuum cleaners and in particular to means for controlling self-propelled upright vacuum cleaners.

2. Description of the Background Art

In one form of upright vacuum cleaner, the wheels carrying the air suction nozzle are driven so as to provide a self-propelled movement of the nozzle over the surface being cleaned under the control of the user. An excellent example of such a vacuum cleaner structure is disclosed in U.S. Pat. No. 3,938,216 of Joseph F. Schmitz et al., which patent is owned by the assignee hereof. As shown therein, the handle of the vacuum cleaner is movably mounted by a spring biasing structure which urges the handle to a central neutral position. The user effects selective forward and rearward movement of the vacuum cleaner by moving the handle longitudinally against the action of the spring biasing structure. The spring biasing structure is mounted in the handle.

Another improved form of drive motor control for an upright vacuum cleaner is disclosed in U.S. Pat. No 3,857,076 of Thomas E. Hetland, which patent is also owned by the assignee hereof. Hetland discloses a reversible vacuum cleaner motor drive which is controlled by longitudinal movement of a handle extending into the bag housing. A cam is selectively engageable with a pair of switches for controlling the operation of the drive motor. Spring biasing means are provided for biasing the handle to a central neutral position.

SUMMARY OF THE INVENTION

The present invention comprehends a further improved handle structure for controlling the drive of a self-propelled upright vacuum cleaner.

More specifically, the invention comprehends such a movable handle control having means for locking the control in a neutral position and permitting facilitated release thereof so as to permit movement of the control selectively to effect forward or reverse operation of the drive.

The invention comprehends a number of different forms of locking means. In one embodiment, the locking means is pivotable about an axis parallel to the longitudinal extent of the handle, and in another embodiment, the locking means is pivotable about an axis transverse thereto.

The manipulatible handle structure is defined by a sleeve longitudinally movable on the distal end of the tubular upright handle.

In the illustrated embodiment, the sleeve comprises two half sleeves which are secured together at their opposite ends.

At the outer end of the sleeve, securing means are provided extending fully through the sleeve. At the opposite inner end, a threaded collar is utilized to maintaining the structural integrity of the handle end by avoiding the need for slots or the like in the handle end.

The locking means is disposed adjacent the securing means so as to maintain the locking means in desired relationship to the handle distal end transversely thereof.

The sleeve and tube end define cooperating stop means for limiting the movement of the sleeve in the opposite directions in effecting the opposite directions of movement of the nozzle.

The locking means includes a projection which is adapted to be inserted into an opening in the distal end of the handle when the sleeve is disposed in the neutral central position. In one form, the opening is elongated transversely of the tube end so as to accept the projection pivoting about an axis parallel to the tube end.

In another form, the opening is circular in cross section.

The handle construction of the present invention is extremely simple and economical, while yet providing improved facilitated control of the vacuum cleaner drive means, including the locking of the control in a neutral position.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figures 1, 2, 5:
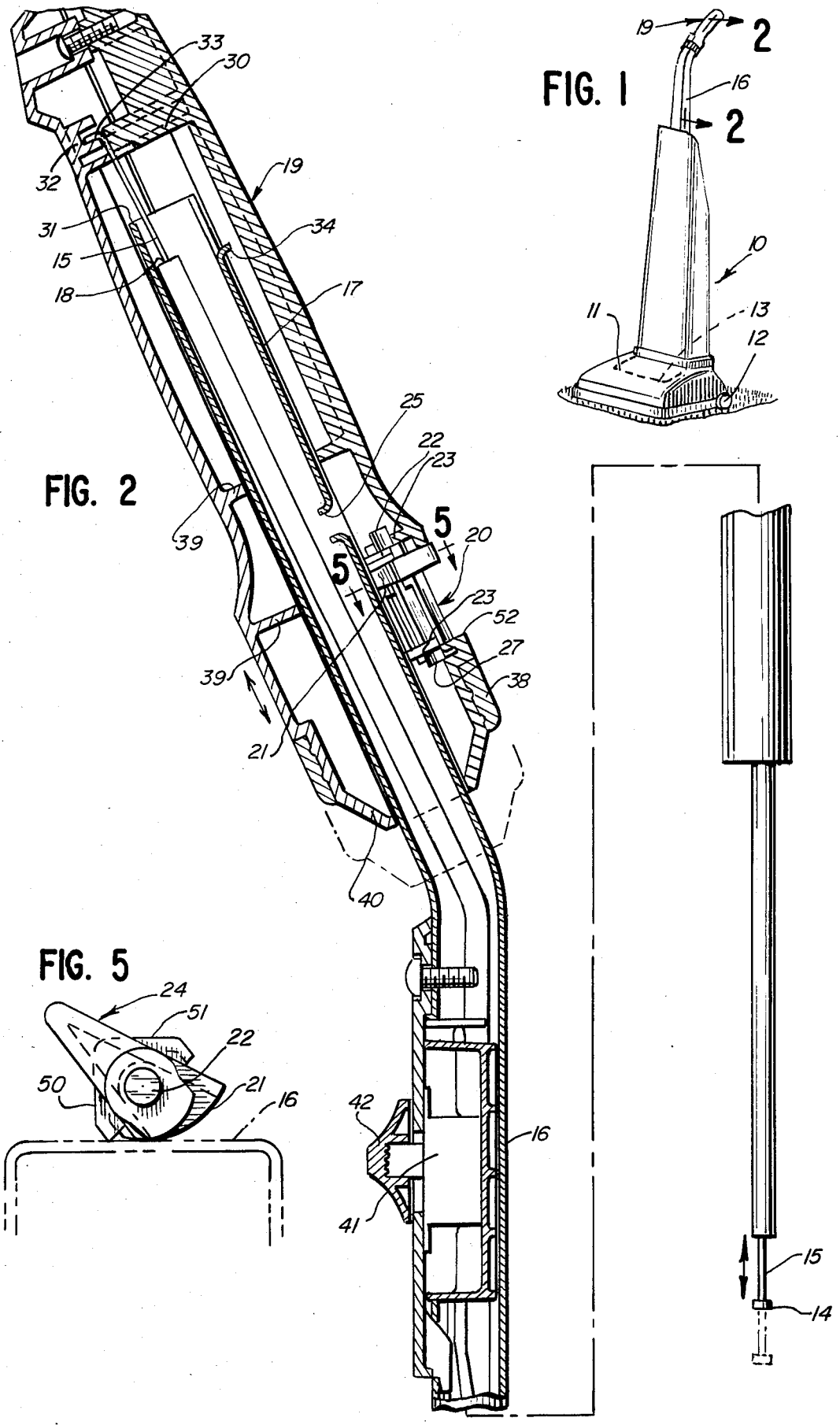
FIG. 1 is a perspective view of a vacuum cleaner having an improved control handle embodying the invention.
FIG. 2 is a fragmentary enlarged diametric section of the control handle.
FIG. 5 is a fragmentary enlarged transverse section taken substantially along the line 5—5 of FIG. 2.

In the exemplary embodiment of the invention as disclosed in FIG. 1, a self-propelled upright vacuum cleaner generally designated 10 is provided with an air suction nozzle 11 having wheels 12 reversibly driven by a suitable reversible drive 13 mounted within nozzle 11. Reversible arrangement of the drive 13 so as to provide selectively either forward or rearward driving of the wheels 12 is effected by moving an actuator 14 at one end of a control cable 15 extending through the hollow handle 16 to the upper distal end 17 thereof.

The distal end 18 of cable 15 is secured to a movable handle or sleeve generally designated 19 which is longitudinally movable on the distal end 17 of handle 16 so as to provide longitudinal movement of the cable and thereby control the forward and reverse operation of drive 13.

Figures 3, 6, 7, 8, 9:
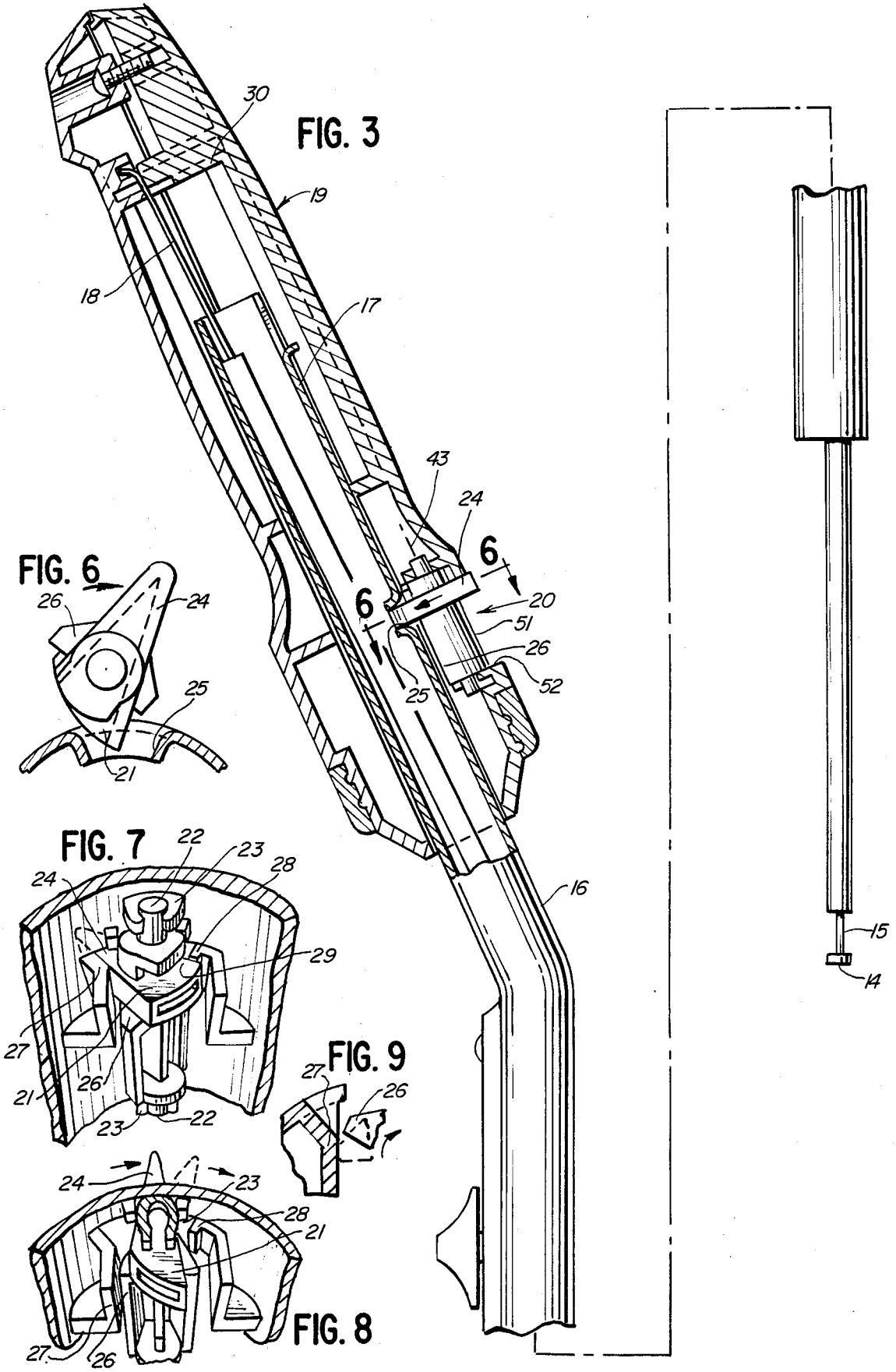
FIG. 3 is a view similar to that of FIG. 2, but illustrating the arrangement of the sleeve locked in the neutral position.
FIG. 6 is a fragmentary enlarged transverse section taken substantially along the line 6—6 of FIG. 3.
FIG. 7 is a fragmentary enlarged perspective view illustrating the locking means in greater detail in the unlocked disposition.
FIG. 8 is a view similar to that of FIG. 7, but illustrating the arrangement of the locking means in the sleeve locking disposition.
FIG. 9 is a sectional view illustrating the toggle means of the locking means.

As shown in FIG. 3, a locking means generally designated 20 is provided for locking the sleeve 19 in a central neutral disposition wherein the cable 15 is longitudinally positioned to maintain the drive 13 in a neutral disposition wherein the wheels 12 are freewheeling.

Locking means 20 includes a catch projection 21 which is pivotally mounted to the sleeve 19 by a pivot 22 journaled in suitable pivot supports 23 formed integrally with the sleeve.

The catch projection 21 further defines an outwardly projecting thumbpiece 24 adapted to be engaged by the user's fingers in manipulating the locking means. As seen in FIGS. 3 and 6, handle distal end 17 is provided with a portion defining an opening 25 adapted to receive the projection 21 when the sleeve 19 is moved longitudinally to align the projection therewith. In the arrangement of FIGS. 3 and 6, the sleeve 19 is locked against longitudinal movement from the neutral position by the reception of the projection 21 in the opening 25.

Formed integrally with the projection 21 is a toggle shoulder 26 which cooperates with a wall portion 27, as seen in FIG. 9, for retaining the locking means selectively in the released and locking positions, as desired.

As further shown in FIG. 7, the manipulating thumbpiece portion 24 engages the wall portion 27 in the extreme movement of the locking means in the counterclockwise direction, as seen therein.

As shown in FIG. 7, a stop shoulder 28 is provided opposite wall portion 27 for cooperating with the portion 29 of the projection 21 in limiting the counterclockwise movement of the projection.

Thus, as seen in FIG. 7, counterclockwise rotation to release the projection 21 from the opening 25 is limited by the abutment of portion 29 with shoulder 28 and thumbpiece 24 with wall portion 27, with the toggle means 26 maintaining the locking means in the released disposition.

As shown in FIG. 8, the projection 21 is brought inwardly by moving the thumbpiece 24 in a clockwise direction so as to urge the thumbpiece to the stop shoulder 28, with the toggle 26 passing beyond the toggle shoulder 27 so as to maintain the locking means in the neutral disposition illustrated in FIGS. 3 and 6.

As seen in FIG. 5, when the thumbpiece 24 is manipulated to bring the projection 21 outwardly from the opening 25, the locking means clears the tubular distal end 17 of the handle, permitting the sleeve 19 to be moved longitudinally in either direction relative to the opening 25. Thus, illustratively, as shown in FIG. 2 in broken lines, the sleeve 19 may be urged forwardly to cause forward operation of the drive 13, with the locking means being disposed outwardly of the handle end 17.

Figures 4, 10, 11, 12, 13:
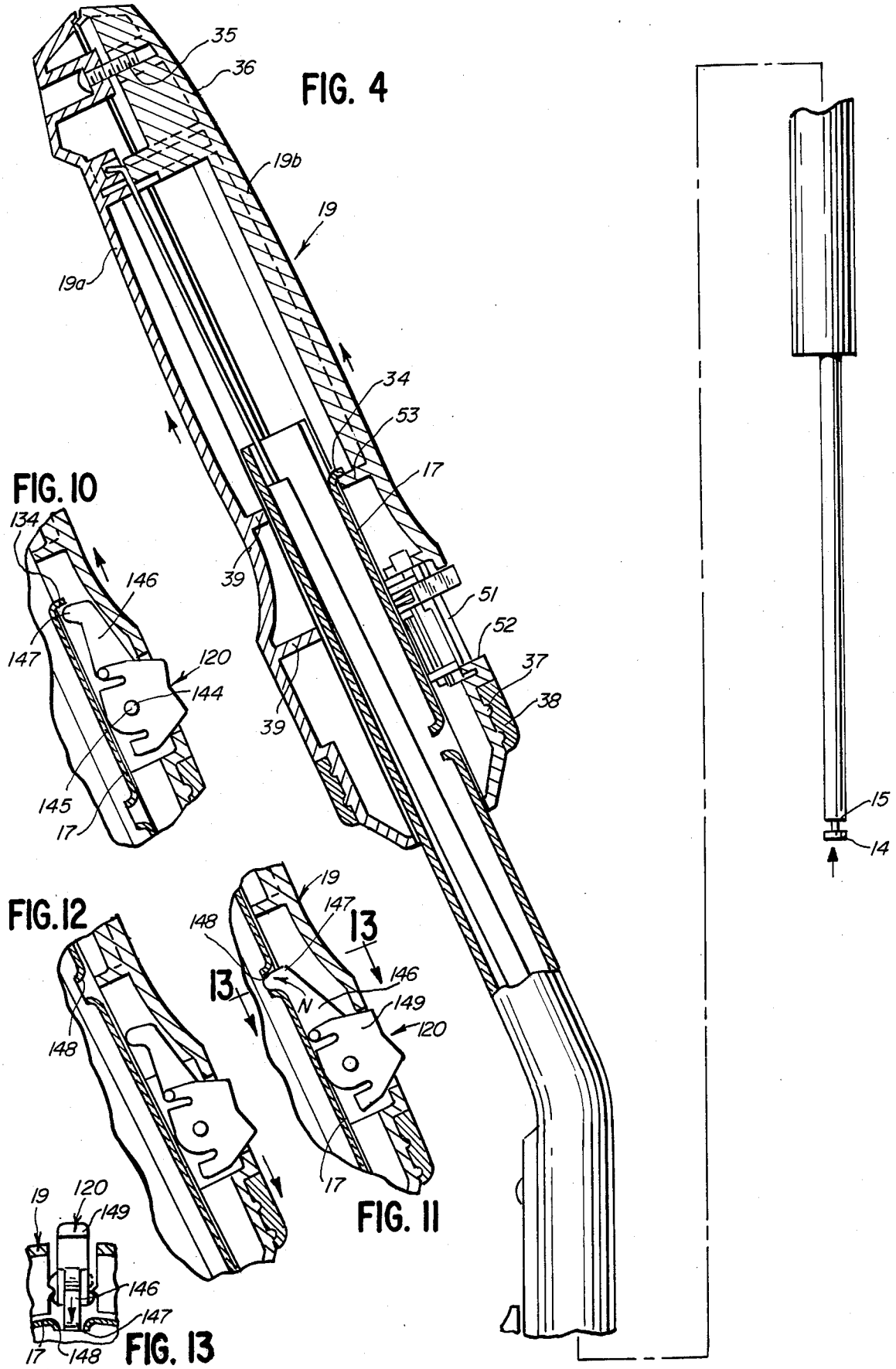
FIG. 4 is a view similar to that of FIG. 2, but with the sleeve disposed in a forwardmost disposition on the handle distal end.
FIG. 10 is a fragmentary longitudinal sectional view illustrating another form of locking means embodying the invention further serving as means for limiting the movement of the sleeve on the distal end of the handle in one direction.
FIG. 11 is a view similar to that of FIG. 10, but with the locking means in the locking disposition.
FIG. 12 is a view similar to that of FIG. 10, but with the sleeve displaced in the opposite direction from the neutral position.
FIG. 13 is a fragmentary diametric section taken substantially along the line 13—13 of FIG. 11.

Reversely, as seen in FIG. 4, with the locking means in the released disposition, the sleeve 19 may be moved rearwardly to urge the actuator 14 suitably to cause the drive means to operate the wheels 12 in the rearward direction.

Movement of the sleeve 19 longitudinally on the handle end 17 is limited in the forward direction by the abutment of an end wall 30 on the sleeve, with the end surface 31 of the handle distal end. As seen in FIG. 2, cable 18 extends past the end wall 30, and is clamped thereby against a recessed cable retainer 32 receiving a turned end portion 33 of the cable.

Movement of the sleeve 19 outwardly is limited, as seen in FIG. 4, by an inturned top wall 53 on the sleeve engaging a turned end portion 34 on the handle end portion 17.

In the illustrated embodiment, sleeve 19 is formed of two longitudinally extending half sleeves **19*a* and 19*b*. The outer end of the half sleeves are secured together by a suitable screw 35, which is recessed within the sleeve outer end portion 36**.

The opposite end of the sleeve halves cooperatively define an external thread 37. A threaded collar 38 is threaded thereto for securing that end of the sleeve halves together. Thus, the sleeve halves are secured in cooperating relationship to define the sleeve 19, while yet may be readily disassociated as by unthreading the collar 38 and removing the screw 35, when desired.

As shown in FIG. 2, the locking means 20 is disposed adjacent the collar 38 for improved retention of the locking means against displacement radially outwardly from the handle end.

As further shown in FIG. 2, the sleeve may be provided with a plurality of inwardly projecting webs 39 for guiding the sleeve on the handle end portion 17. As shown, the end wall 40 of the sleeve further is inturned so as to provide further guidance of the sleeve at the forward end thereof on the handle end portion 17.

Speed of the drive means may be controlled by a slide switch 41 carried by the handle 16 below the end portion 17. The switch is provided with a suitable manipulating portion 42 for selectively positioning the switch either in an "Off" position, a "High" speed condition, or a "Low" speed condition as desired.

As discussed above, locking means 20 is pivotable about an axis 43 which extends parallel to the longitudinal extent of the handle distal end 17. The opening 25 is elongated transversely of the handle end portion 17 to accommodate the transverse movement of the projection 21, as illustrated in FIG. 6.

Referring to the embodiment of FIGS. 10–13, a modified form of locking means is shown to comprise a locking means generally designated 120 pivotable on pivots 144 about an axis 145 which extends transversely to the longitudinal extent of the handle portion 17. The locking means 120 includes a nose portion 146 defining a turned end 147 adapted to be received in an opening 148 in the handle end portion 17 to lock the sleeve against longitudinal movement, as seen in FIG. 11. Opening 148, in the illustrated embodiment, has a circular cross section.

Locking means 120 further includes a manipulating portion 149 adapted to be engaged by the user's thumb in pivoting the locking means so as to insert or remove nose end 147 relative to the opening 148.

Thus, when it is desired to move the sleeve 19 longitudinally from the neutral position of FIG. 11, the user merely presses on the manipulating portion 149 so as to rotate it in a clockwise direction from the position of FIG. 11 to the position of FIG. 12, removing the turned end 147 from opening 148 and allowing the sleeve to be moved in either longitudinal direction from the neutral position as desired. Movement of the sleeve in the forward direction is illustrated in FIG. 12 and in the rearward direction in FIG. 10. Rearward movement is limited by top wall 53.

In the illustrated embodiment, the lock means are preferably formed as by molding from a suitable synthetic resin, such as Delrin. The inherent resiliency of this material permits the desired toggle action discussed above relative to the first embodiment and the locking function discussed above relative to the second embodiment. Thus, the locking means is extremely simple and economical of construction while yet providing for positive retention of the sleeve in the neutral position and facilitated selective release and movement of the sleeve to effect the desired forward or rearward movement of the drive means.

The unique construction of the handle control means permits the sleeve to move a relatively long distance, such as greater than 2½ inches, and in the illustrated embodiment, the handle moves approximately 2.6 inches between its extreme forward and reverse positions discussed above.

As discussed above, the use of the threaded retaining means on the forward end of the sleeve in holding the two sleeve halves together permits the sleeve to be relatively short, while yet providing the highly desirable lengthy travel and, at the same time, eliminating the need for a slot in the handle end portion 17 to accommodate the desired forward and backward movement of the sleeve in the use of the power drive.

In each of the embodiments, the user may readily cause the insertion of the locking means projection into the opening in the handle end portion by suitably pressing on the manipulating portion, while sliding the sleeve until the thusly urged projection moves into the opening.

To assist the user in determining the disposition of the locking means, the locking means may further define a pair of indicator surfaces 50 and 51 viewable through an opening 52 in the sleeve, which may bear suitable indicia, such as "Neutral" and "Drive" (not shown).

The foregoing disclosure of specific embodiments is illustrative of the broad inventive concepts comprehended by the invention.

I claim:

1. In a vacuum cleaner having a dirt pickup suction nozzle provided with carriage wheels, drive means for selectively forwardly and rearwardly driving said wheels, and a handle extending upwardly from the nozzle for use in manually guiding the nozzle in a suction cleaning operation, improved means for manipulating the vacuum cleaner comprising:

means on said handle defining an elongate distal end;

a sleeve longitudinally movably carried on said handle distal end;

connecting means extending along said handle from said sleeve to said nozzle for controlling said drive means as a function of the disposition of said sleeve on said handle distal end;

cooperating locking means on said sleeve and handle distal end for selectively locking the sleeve in a preselected neutral disposition wherein said connecting means causes said drive means to be in a neutral disposition wherein the wheels are undriven;

first cooperating stop means on said sleeve and handle distal end for defining a first displaced disposition of the sleeve and connecting means disposed in a first longitudinal direction from said neutral disposition of the sleeve for causing operation of the drive means in a forward direction as a function of the displacement of said sleeve from said neutral disposition to said first displaced disposition; and second cooperating stop means on said sleeve and handle distal end for defining a second displaced disposition of the sleeve and connecting means disposed in an opposite second, longitudinal direction from said neutral disposition of the sleeve for causing operation of the drive means in a rearward direction as a function of the displacement of said sleeve from said neutral disposition to said second displaced disposition, said manipulating means further defining speed control means for selectively varying the speed of the drive means.

2. The vacuum cleaner structure of claim 1 wherein said speed control means is mounted to said handle at said distal end.

3. The vacuum cleaner structure of claim 1 wherein said speed control means comprises electrically operable means including a selector switch on said handle.

4. The vacuum cleaner structure of claim 1 wherein one of said stop means comprises an end surface of the handle distal end and a confronting transversely extending wall portion of the sleeve.

5. The vacuum cleaner structure of claim 1 wherein one of said stop means comprises confronting transversely projecting portions of the handle distal end and sleeve.

6. The vacuum cleaner structure of claim 1 wherein said locking means comprises a portion of said handle distal end defining an opening, and a rocker latch pivotally carried by the sleeve and having a projection arranged to be received in said opening when the sleeve is in said neutral position and thereby lock the sleeve against longitudinal movement from said neutral position.

7. The vacuum cleaner structure of claim 1 wherein said locking means comprises a portion of said handle distal end defining an opening, and a rocker latch carried by the sleeve for pivotal movement about an axis parallel to the longitudinal extent of said handle distal end and having a projection arranged to be received in said opening when the sleeve is in said neutral position and thereby lock the sleeve against longitudinal movement from said neutral position.

8. The vacuum cleaner structure of claim 1 wherein said locking means comprises a portion of said handle distal end defining an opening, and a rocker latch carried by the sleeve for pivotal movement about an axis transversely to the longitudinal extent of said handle distal end and having a projection arranged to be received in said opening when the sleeve is in said neutral position and thereby lock the sleeve against longitudinal movement from said neutral position.

9. The vacuum cleaner structure of claim 1 wherein said locking means comprises a portion of said handle distal end defining an opening, and a rocker latch carried by the sleeve for pivotal movement about an axis parallel to the longitudinal extent of said handle distal end and having a projection arranged to be received in said opening when the sleeve is in said neutral position and thereby lock the sleeve against longitudinal movement from said neutral position, said opening being elongated transversely of said distal end.

10. The vacuum cleaner structure of claim 1 wherein said locking means comprises a portion of said handle distal end defining an opening, and a rocker latch carried by the sleeve transversely to the longitudinal extent of said handle distal end and having a projection arranged to be received in said opening when the sleeve is in said neutral position and thereby lock the sleeve against longitudinal movement from said neutral position, said opening being circular in cross section.

11. The vacuum cleaner structure of claim 1 wherein said locking means comprises a portion of said handle distal end defining an opening, and a rocker latch pivotally carried by the sleeve and having a projection arranged to be received in said opening when the sleeve is in said neutral position and thereby lock the sleeve against longitudinal movement from said neutral position, said rocker latch and sleeve having cooperating stop shoulders for releasably retaining the projection in said opening.

12. The vacuum cleaner structure of claim 1 wherein said locking means comprises a portion of said handle distal end defining an opening, and a rocker latch pivotally carried by the sleeve and having a projection arranged to be received in said opening when the sleeve is in said neutral position and thereby lock the sleeve against longitudinal movement from said neutral position, the shoulder on said rocker latch being resiliently deflectible.

13. The vacuum cleaner structure of claim 1 wherein one of said stop means comprises confronting transversely projecting portions of the handle distal end and sleeve, said locking means comprising a portion of said handle distal end defining an opening, and a rocker latch pivotally carried by the sleeve and having a projection arranged to be received in said opening when the sleeve is in said neutral position and thereby lock the sleeve against longitudinal movement from said neutral position, said rocker latch defining the confronting transversely projecting portion of the sleeve.

14. The vacuum cleaner structure of claim 1 wherein the longitudinal movement of the sleeve on the handle distal end is greater than approximately 2½ inches.

15. In a vacuum cleaner having a dirt pickup suction nozzle provided with carriage wheels, drive means for selectively forwardly and rearwardly driving said wheels, and a handle extending upwardly from the nozzle for use in manually guiding the nozzle in a suction cleaning operation, improved means for manipulating the vacuum cleaner comprising:

means on said handle defining an elongate distal end;

a pair of sleeve halves defining a sleeve longitudinally movably carried on said handle distal end;

first securing means recessed within said sleeve for securing an end portion of the sleeve halves together about said handle distal end;

second securing means externally of the opposite end portion of the sleeve halves for securing said opposite end portions together about said handle distal end in sleeve-forming relationship whereby said sleeve may be moved relative to said handle while having maintained structural integrity of said handle end within said second securing means;

connecting means extending along said handle from said sleeve to said nozzle for controlling said drive means as a function of the disposition of said sleeve on said handle distal end;

cooperating locking means on said sleeve and handle distal end for selectively locking the sleeve in a preselected neutral disposition wherein said connecting means causes said drive means to be in a neutral disposition wherein the wheels are undriven; and cooperating stop means on said sleeve and handle distal end for selectively defining opposite displaced dispositions of the sleeve and connecting means for causing operation of the drive means in a forward direction as a function of the displacement of said sleeve from said neutral disposition to a first displaced disposition and causing operation of the drive means in a rearward direction as a function of the displacement of said sleeve from said neutral disposition to a second, opposite displaced disposition.

16. The vacuum cleaner structure of claim 15 wherein the stop means on the sleeve is disposed adjacent one of said securing means whereby said stop means on the sleeve is maintained against displacement transversely away from the handle distal end.

17. The vacuum cleaner structure of claim 15 wherein the stop means on the sleeve is disposed adjacent said second securing means whereby said stop means on the sleeve is maintained against displacement transversely away from the handle distal end.

18. The vacuum cleaner structure of claim 15 wherein said second securing means comprises a threaded outer surface on the sleeve halves and a threaded collar threaded thereabout.

19. The vacuum cleaner structure of claim 15 wherein said locking means includes a thumbpiece projecting outwardly from the sleeve for manipulation by a user of the vacuum cleaner.

20. The vacuum cleaner structure of claim 15 wherein said locking means includes a thumbpiece projecting outwardly from the sleeve for manipulation by a user of the vacuum cleaner parallel to the longitudinal extent of the sleeve.

21. The vacuum cleaner structure of claim 15 wherein said locking means includes a thumbpiece projecting outwardly from the sleeve for manipulation by a user of the vacuum cleaner transversely of the longitudinal extent of the sleeve.

* * * * *